United States Patent [19]

Hall et al.

[11] 4,311,034

[45] Jan. 19, 1982

[54] PROCESS AND APPARATUS FOR FORMING COMPRESSED CRIMPED METAL FOIL HEATER RIBBON

[75] Inventors: James A. Hall; Raymond C. Kent, both of Lancaster, Pa.

[73] Assignee: Armstrong World Industries, Lancaster, Pa.

[21] Appl. No.: 139,553

[22] Filed: Apr. 11, 1980

[51] Int. Cl.[3] ..... B21D 13/08

[52] U.S. Cl. ..... 72/318; 72/187; 72/379

[58] Field of Search ..... 72/187, 301, 302, 316, 72/318, 379; 264/282, 286, 287; 113/1 C, 116 Y

[56] References Cited

U.S. PATENT DOCUMENTS 2,329,789 9/1943 Schank et al. ..... 72/187

3,474,513 10/1969 Allingham ..... 72/379

*Primary Examiner*—Lowell A. Larson

[57] ABSTRACT

A process and apparatus for uniformly compressing pre-crimped electric conductive metal foil ribbon to achieve a high density of crimps per unit length and an increased ratio of crimp depth-to-pitch between successive crimps is disclosed. The apparatus forms an elongated passageway adapted to slidably receive a crimped foil ribbon therein. The bottom portion of a pre-crimped foil ribbon positioned in the passageway is releasably held in place. A probe is inserted through a slot in the cover plate on the apparatus into a crimp in the ribbon and the probe and crimps are moved toward the portion of the ribbon being held in place to compress the moved crimped portion.

Release of holding pressure on the bottom portion of the foil ribbon allows the compressed foil to be advanced and the process is repeated until the desired length of compressed crimped foil is produced.

7 Claims, 5 Drawing Figures

PROCESS AND APPARATUS FOR FORMING COMPRESSED CRIMPED METAL FOIL HEATER RIBBON

BACKGROUND OF THE INVENTION

This invention relates generally to a process and apparatus for forming crimped electric conductive metal foils. More specifically, the invention relates to a process and apparatus whereby such foil ribbons after pre-crimping may be compressed lengthwise to provide a high density of deep, uniform crimps per unit length and thereby increase the unit length heating surface thereof.

In the past a typical method for producing crimped foil ribbons was to pass them between two meshing gears. U.S. Pat. No. 2,731,713, for example, discloses that corrugations in a strip of resistance material may be formed by passing the material between the teeth of a pair of gears. The patent further states that the shape of the corrugations may be altered by altering the shape of the gear teeth from the conventional gear tooth cross section and that the size of the teeth of the gears determine the size of the corrugations. It is further stated that the size of the gear teeth may be of any fineness down to 100 pitch or smaller. Another patent relating to the feeding of foil between meshing gears to provide corrugations therein is disclosed in U.S. Pat. No. 2,826,105 which relates to a hand held and operated device for forming the corrugations in the foil. U.S. Pat. No. 1,345,445 relates to a machine for crimping wire wherein a swinging arm or bracket bends or loops the wire while it is being held by a pair of grooved rollers. The feeding motion of the wire is arrested during the crimping operation and then operated again to bring a new section of wire into position for crimping and the process is repeated. U.S. Pat. No. 2,683,500 relates to a filter unit and the method for producing the same, wherein wire filaments or strands are double crimped by feeding the wire or strands between a first set of intermeshing crimping rolls to impart an initial crimp end of the wire filaments or strands, and this so pre-crimped wire filament is then passed between a set of crimping rolls which act to produce large crimps in the filament and in effect serves to compress the pre-crimped metal foil. In other words, crimps of a large pitch are superimposed upon the crimps of small pitch. The wire filaments so crimped are fed to a receiving trough where they're mutually intertangled and felted together to form a filter body which is then enveloped in a jacket of tubular knit mesh.

The prior art shows no recognition of the problem solved by this invention and consequently offers no solution therefor. The problem being how to provide an electric conductive metal ribbon with a very high density of crimps per unit length and an increased ratio of crimp depth-to-pitch between successive crimps in order that a shorter length of the crimped foil ribbon having an increased electric conductive surface area might be used in the construction of small compact electric heaters and the like, which could be operated directly to 120 volts with a wattage output of less than 500 watts.

Obviously, the difficulty with providing crimps in a metal foil ribbon by passing it between two meshing gears is that there is a physical limit to the surface area of crimped foil that can be achieved in a given length. The gear-type former has a limited depth of crimp for a given pitch between successive crimps. Any attempt to go beyond this limit causes backlash between gears (one tooth gouges or undercuts the side of a mating tooth). For American Standard 14½° or 20° involute gear teeth, the tooth depth is 69% of the space between teeth, regardless of gear pitch. The process of this invention allows a crimp depth of at least two times the pitch between successive crimps to be achieved. Therefore, this invention makes it possible to form a heater ribbon with more surface area per unit of finished length.

SUMMARY OF THE INVENTION

This invention relates to a process and apparatus for forming electric conductive metal foil ribbons having a very high density of crimps per unit length and an increased ratio of crimp depth-to-pitch between successive crimps, which, consequently, provides an increased unit length heating surface in a shorter overall length of ribbon than was previously possible. The apparatus comprises a flat base plate on which there is mounted an elongated stationary jaw with a stationary support bar of similar length mounted in spaced relation thereto. An elongated adjustable jaw of shorter length than the stationary jaw is mounted between the support bar and the stationary jaw on screw threaded adjusting bolts carried by the support bar, and is spaced away from the stationary jaw a distance slightly greater than the crimp height of the foil to be fed therebetween. A short movable holding jaw positioned below the adjustable jaw is mounted on a pair of threaded bolts which pass through openings in the stationary support bar to a pressure plate. Springs mounted on the bolts between the pressure plate and the stationary bar hold the movable jaw in a normally retracted position away from the stationary jaw. A friction material facing is provided on similar areas of opposing surfaces of the movable holding jaw and the stationary jaw. A cover plate mounted on the face of the apparatus is provided with a slot in line with the space between the opposed edges of the jaw members to permit a probe to be inserted through the slot so that lengthwise pressure may be exerted on the foil to compress it as it is being held at the bottom of the apparatus by the holding jaw through pressure applied to the pressure plate. After compression of the crimped foil, pressure is released from the pressure plate and the holding jaw is spring urged away from the foil ribbon and the stationary jaw. The compressed foil is then advanced and the process is repeated.

By the process and apparatus of this invention, it is possible to, in a surprisingly simple and inexpensive manner, produce an electric conductive uniformly crimped metal foil having a greater amount of heating surface per unit length than was previously achievable by the processes and apparatus of the prior art.

DESCRIPTION OF THE PREFERRED EMBODIMENT

Figure 1:
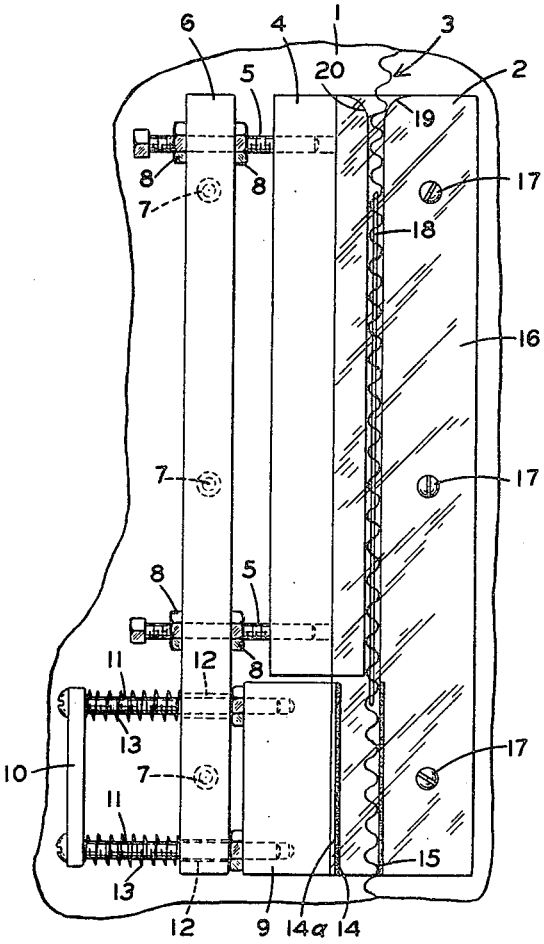
FIG. 1 is a front elevational view, partially broken away, of the apparatus of this invention with a pre-crimped length of metal ribbon in place therein.
Figure 3:
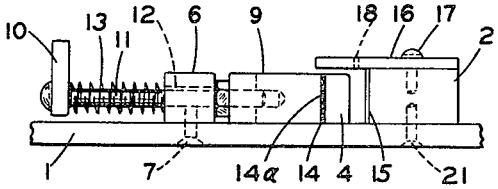
FIG. 3 is a bottom end elevational view of the apparatus shown in FIG. 1, with the foil ribbon removed.

In FIG. 1 of the drawings, there is shown an apparatus for compressing pre-crimped metal foil ribbon. The apparatus comprises a flat metal base plate 1 which has mounted thereon an elongated substantially rectangular stationary guide jaw member 2 having a thickness slightly greater than the width of the foil ribbon 3 which is to be passed through the apparatus. The stationary guide jaw 2 extends the entire length of the apparatus. An adjustable guide jaw 4 positioned opposite the stationary jaw 2, is spaced therefrom a distance slightly greater than the height of the crimps in the foil 3, and extends from the top of the apparatus to a point spaced upwardly from the bottom thereof. The adjustable guide jaw 4 is mounted by means of screw threaded adjusting bolts 5 on a stationary support bar 6. The stationary support bar 6 is mounted on the base plate 1 by means of fasteners 7. Nuts 8 are provided on the adjusting bolts 5 for securing the adjustable guide jaw in place at the desired spacing away from stationary guide jaw 2. A short movable holding jaw 9 is positioned below the adjustable jaw 4 and extends from the bottom end thereof to the end of the apparatus. The movable holding jaw 9 is mounted on a pressure plate 10 by means of screw threaded bolts 11 which pass through openings 12 in the stationary support bar 6. Springs 13 mounted on bolts 11 between the pressure plate 10 and the stationary bar 6 hold the movable jaw 9 in a normally retracted position as shown in FIG. 1. Opposing surfaces of the movable holding jaw 9 and the stationary jaw 2 are provided with friction material facings 14 and 15. As shown in FIG. 1 and as best seen in FIG. 3, a transparent top cover plate 16 is mounted on the face of the stationary guide jaw 2 by means of screws 17 to extend over the space between the stationary guide jaw 2 and a portion of the adjustable guide jaw 4 and the movable holding jaw 9. The top cover plate 16 is provided with a centrally located lengthwise slotted opening 18 which is centrally located over the space between the jaw members 2 and 4. The opposed top edges of the jaw members 2 and 4 are rounded as shown at 19 and 20 to facilitate feeding of the foil ribbon 3 downwardly through the elongated passageway formed by the space between the opposed edges of jaw members 2 and 4 together with the base plate 1 and the cover plate 16. Stationary jaw member 2 is mounted on the base plate 1 by means of fastening members 21, one of which is shown in FIG. 3.

The foil 3 to be compressed by the apparatus of this invention is normally pre-crimped in a known manner by passing it between a pair of meshing gears. However, although the shape of the corrugations in the foil may be altered by altering the shape of the gear teeth from the conventional gear tooth cross-section and the size of the gear teeth may be any fineness down to 100 pitch or smaller, as the fineness of the gear teeth and number of teeth of the gears increase, the depth of the crimps capable of being formed by such gears decreases. In other words, there is a physical limit to the surface area of heater ribbon per unit length that can be formed by rotating gears. A gear type former also has a limited depth of crimp for a given pitch between successive crimps. A previously stated herein, any attempt to go beyond this limit causes backlash between gears (one tooth gouges or undercuts the side of the mating tooth). For American Standard 14½° or 20° involute gear teeth, the tooth depth is 69% of the space between the teeth, regardless of gear pitch. Through the use of the apparatus of this invention, a crimp depth of at least two times the pitch between successive crimps is achieved. This invention therefore makes it possible to provide a heating foil ribbon with greatly increased surface area per unit of finished length. Such ribbons are particularly useful in the construction of small heaters of the air stream type wherein the heating surface area of the ribbon may be predetermined to provide the required electrical resistance to enable it to operate directly on 120 volts with a wattage output of less than 500 watts. This invention allows the required amount of ribbon heating surface to be confined in a minimum heater space.

The metal foil used for the ribbons 3 normally has a width in the range of from about 0.250 to 0.750 inch (6.35 to 19.05 mm), and a thickness in the range of from about 0.001 to 0.005 inch (0.025 to 0.127 mm). The number of crimps per inch (2.54 cm) is in the range of about 6 to 13 with the ratio of crimp depth to pitch between successive crimps being in the range of 1:1 to 2:1.

A typical 125 volt, 500 watt heater would require a crimped foil ribbon 0.5 inch (12.70 mm) wide by 0.002 inch (0.051 mm) thick with a resistance of 0.5 ohm per foot (0.305 M) and having about 13 crimps per inch (2.54 cm). The pitch between the crimped peaks would be about 0.085 inch (2.159 mm) and the crimp depth about 0.154 inch (3.91 mm). Approximately a 58 feet (17.678 meters) length of the uncrimped foil is required for a 120 volt, 500 watt unit.

Metal foils usable in small air stream heaters should have a high electric resistance per unit length, and should be able to withstand the high temperatures produced. The foil should be ductile and workable. A typical foil stock with such desirable properties is Inconel. Obviously, other materials would also be suitable, but the geometry of the crimped ribbon would vary depending on the thickness, ductility, and work-hardening characteristics of the foil used.

Figure 2:
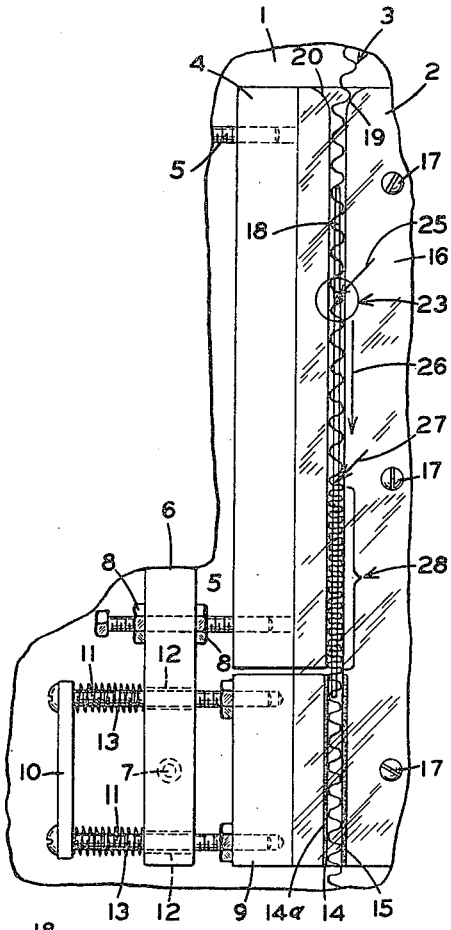
FIG. 2 is a front elevational view, partially broken away, showing a portion of the pre-crimped ribbon being held in place and a compressed portion of the ribbon as it would appear after the first compression step.
Figure 2A:
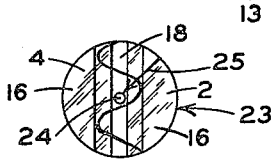
FIG. 2*a* is an enlarged view of the encircled portion 23 of FIG. 2, showing the probe inserted through the slot in the cover plate and into a crimp in the foil prior to lengthwise compressing pressure being exerted thereon.
Figure 4:
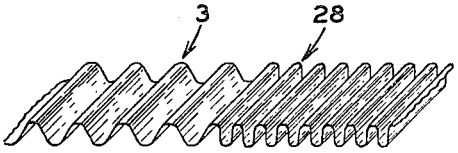
FIG. 4 is a perspective view of a portion of the foil ribbon showing pre-crimped and compressed portions thereof.

In forming the above-described compressed metal foil ribbons by using the apparatus of this invention, a length of the foil ribbon 3 which has been pre-crimped by the meshing gear method is fed as shown in FIG. 1 into the space between the opposing edges of jaw members 2 and 4 until it reaches the bottom end of the apparatus. As shown in FIG. 1, at this point, the movable holding jaw 9 is held in its normally retracted position by means of the springs 13. In the next step of the operation, pressure is applied to pressure plate 10 to move it and the movable holding jaw 9 toward the stationary guide jaw 2 until the friction facing material 14 on the edge **14*a* of the movable holding jaw 9 contacts the pre-crimped foil 3, thus clamping the foil 3 between the jaws 9 and 2 and holding it in place by means of the friction material facings 14 on the edge 14*a* of the jaw 9 and the facing 15 on the opposing edge of the stationary guide jaw 2** as shown in FIG. 2 of the drawings. As best shown in FIGS. 2 and 2*a* of the drawings, the probe 24 is then inserted into the slot 18 in the transparent top cover plate 16 at approximately the point indicated by the arrow 25. An enlarged view of the encircled area 23 is shown in FIG. 2*a* of the drawings. The probe 24 is then moved downwardly in the direction shown by the arrow 26 to approximately a point indicated by the arrow 27, thus compressing the foil as shown in the area indicated by the numeral 28. Pressure is then released from the pressure plate 10 allowing springs 13 to force the movable holding jaw 9 away from the stationary guide jaw 2, thus allowing the compressed portion 28 of the foil to be moved downwardly where it is again clamped between the movable jaw 9 and the stationary guide jaw 2 and the compressing process just described is repeated again and again until the desired length of compressed foil is obtained. Shown in FIG. 4 is a perspective view of the ribbon 3 in its pre-crimped condition and a section of the portion 28 thereof in its compressed condition.

Although the apparatus of this invention has been shown and described as a simplified hand operated device, obviously, the device could be automated to increase production speed. For example, one way of doing this would be to use an air cylinder to position and retract the movable holding jaw 9, use an air cylinder to insert and retract the probe 24; use another air cylinder and slider mechanism to move the inserted probe from position 23 to 27, and return the retracted probe from position 27 to 23. Suitable air solenoids, limit switches and electric relays well known in the machinery manufacturing trade would be used to actuate and sequence the air cylinders. Ribbon stock would be fed from a roll through motor-driven pre-crimping gears timed to run at a speed compatible with the ribbon crimper.

While certain embodiments and details have been shown for the purpose of illustrating the invention, it will be apparent to those skilled in this art that various changes and modifications may be made therein without departing from the spirit or the scope of the invention. What is claimed is:

1. An apparatus for uniformly compressing pre-crimped metal foil ribbons lengthwise comprising (a) a base plate;

(b) an elongated stationary jaw mounted on said base plate;

(c) an elongated adjustable jaw of shorter length than said stationary jaw and positioned opposite thereto, said stationary and adjustable jaws having spaced-apart opposed edge portions;

(d) an elongated stationary support bar mounted on said base plate in lateral spaced relation to said adjustable jaw;

(e) adjusting means extending from said stationary support bar to the adjustable jaw to provide lateral movement thereto;

(f) a movable holding jaw positioned below said adjustable jaw, said movable holding jaw and said stationary jaw having normally spaced-apart opposed edge portions;

(g) means extending through said stationary support support bar to said movable holding jaw for providing lateral movement thereto;

(h) means connected with said holding jaw moving means for holding the movable jaw in a normally retracted position with respect to the opposed edge portions of the stationary jaw to space them apart a distance greater than the spacing between the opposing edges of the stationary and adjustable jaws;

(i) a cover plate mounted on the face of said stationary jaw and extending partially over said adjustable jaw and said movable holding jaw, said cover plate together with the base plate and the opposed spaced-apart portions of said stationary and adjustable jaws forming an elongated channel adapted to slidably receive a pre-crimped foil ribbon therein, said cover plate having a slotted opening centrally located over the space between the opposing edges of the stationary and adjustable jaws; and (j) compressing means for insertion through one end of the slot in the cover plate to penetrate into a crimp in the pre-crimped ribbon when it is positioned in the elongated opening formed by the cover plate together with the base plate and the opposed spaced-apart edges of the stationary and adjustable jaws, said compressing means being movable to compress the pre-crimped foil lengthwise as the compressing means is moved along the slot in the cover plate from one end of the slot to the other end thereof toward the portion of the ribbon held immobile by the movable holding jaw forced thereagainst by pressure applied to the holding jaw moving means, said compressing means being adapted to be moved back to its first position.

2. The apparatus according to claim 1 wherein the base plate has a flat upper surface, the stationary jaw is substantially rectangular in shape, has a thickness slightly greater than the width of the foil ribbon, and extends along the entire length of the apparatus.

3. An apparatus according to claim 2 wherein the thickness of the edge portion of the adjustable jaw opposed to the edge portion of the stationary jaw is approximately the same thickness as the width of the foil ribbon and wherein the top end of the adjustable jaw is even with the top end of the stationary jaw and the top corners of the opposing edges of the stationary and adjustable jaws are rounded and, wherein the adjustable jaw extends lengthwise parallel to the stationary jaw to a point spaced upwardly from the bottom thereof and wherein the opposing edge portions of the stationary and adjustable jaws are spaced apart a distance slightly greater than the crimp-height of a pre-crimped foil to be passed therebetween.

4. The apparatus according to claim 3 wherein the adjusting means for the adjustable jaw comprises screw threaded bolts and locking nuts.

5. The apparatus according to claim 4 wherein the movable holding jaw extends from a point adjacent the bottom end of the adjustable jaw to the end of the apparatus and, wherein opposing surfaces of the edges of the movable holding jaw and the stationary jaw are provided with a friction material facing.

6. The apparatus according to claim 5 wherein the means for moving the holding jaw includes a pair of screw threaded bolts slidably mounted in openings in the stationary support bar, a pressure plate mounted on said bolts in spaced-away relation to said stationary support bar and, spring means on said bolts between said pressure plate and said stationary support bar.

7. The apparatus according to claim 6 wherein the cover plate is transparent.

* * * * *